US006328039B1

(12) United States Patent
Chang

(10) Patent No.: US 6,328,039 B1
(45) Date of Patent: Dec. 11, 2001

(54) ARTIFICIAL NAIL WITH DECORATIVE INSERTS

(75) Inventor: Sung Yong Chang, Roslyn Heights, NY (US)

(73) Assignee: KMC Exim Corporation, Port Washington, NY (US)

( * ) Notice: Subject to any disclaimer, the term of this patent is extended or adjusted under 35 U.S.C. 154(b) by 0 days.

(21) Appl. No.: 09/662,014

(22) Filed: Sep. 14, 2000

(51) Int. Cl.[7] ..... A45D 29/00
(52) U.S. Cl. ..... 132/73; 132/73.5
(58) Field of Search ..... 132/73, 285, 200; 428/67, 77, 78, 79; D28/56, 62; 63/2, 20, 15.8, 15

(56) References Cited

U.S. PATENT DOCUMENTS

| | | | | |
|---|---|---|---|---|
| D. 303,161 | * | 8/1989 | Tomkins | D28/56 |
| D. 384,440 | | 9/1997 | Meyerovich . | |
| D. 387,488 | | 12/1997 | Meyerovich . | |
| D. 388,544 | | 12/1997 | Meyerovich . | |
| 2,013,290 | | 9/1935 | Rohrbach . | |
| 2,162,155 | | 6/1939 | Calvin . | |
| 2,199,207 | | 4/1940 | Nolan . | |
| 2,941,535 | | 6/1960 | Lappe . | |
| 3,598,685 | | 8/1971 | Lee et al. . | |
| 3,847,831 | | 1/1970 | Jaume et al. . | |
| 4,220,016 | | 9/1980 | Frenger . | |
| 4,361,160 | | 11/1982 | Bryce . | |
| 4,581,088 | | 4/1986 | House . | |
| 4,793,155 | | 12/1988 | Law . | |
| 4,876,121 | | 10/1989 | Cohen . | |
| 5,239,840 | * | 8/1993 | Sutterlin | 63/2 |
| 5,269,330 | | 12/1993 | Hayes . | |
| 5,699,813 | | 12/1997 | Carroll . | |
| 5,724,999 | | 3/1998 | Kim . | |
| 5,860,429 | * | 1/1999 | Chang | 132/73 |
| 5,890,495 | | 4/1999 | Cain . | |
| 5,908,035 | | 6/1999 | Carroll et al. . | |
| 5,934,290 | | 8/1999 | Carroll et al. . | |
| 5,944,027 | * | 8/1999 | Chang | 132/200 |
| 5,975,087 | | 11/1999 | Jang . | |
| 6,206,009 | * | 3/2001 | Paxson | 132/73 |

* cited by examiner

*Primary Examiner*—Pedro Philogene
(74) *Attorney, Agent, or Firm*—Hoffman & Baron, LLP

(57) ABSTRACT

An ornamental accessory for a fingernail comprises an overlay, a cover and at least one decorative element. A recess is formed in the top surface of the overlay for receiving the decorative element and the cover is fixed over the recess to form an enclosed pocket for containing the decorative element. The decorative elements may be metallic flakes, glitter, confetti, natural gemstones, artificial gemstones or combinations thereof and are preferably freely movable within the pocket of the overlay. In an alternate embodiment, the overlay includes a raised decorative portion formed on the top surface as opposed to a recess. A method for adorning a fingernail or toenail in accordance with the present invention includes the steps of attaching an overlay having a recess formed therein to the natural fingernail or toenail of a wearer, inserting at least one decorative element within the recess and adhering a cover to the top surface of the overlay over the recess thereby forming an enclosed pocket in the overlay for containing the decorative element. The present invention may also be provided as a kit for adorning fingernails or toenails.

16 Claims, 4 Drawing Sheets

ARTIFICIAL NAIL WITH DECORATIVE INSERTS

BACKGROUND OF THE INVENTION

The present invention relates to the art of ornamental accessories for fingernails or toenails, and, in particular, to an artificial fingernail having an enclosed pocket for containing one or more decorative elements.

It has been known in the art of adorning the hands to provide ornamental fingernail accessories made from thin, molded plastic members manufactured generally in the shape of a fingernail. Indeed, numerous artificial fingernail manufacturers have provided a variety of combinations of materials, arrangements, and colors in fingernail accessories. With the advent of such artificial fingernail accessories, the wearer could now have intricately pre-designed fingernails that are simply attached to the natural fingernail and then later easily removed.

For example U.S. Pat. No. 5,699,813 to Carroll discloses a full cover artificial fingernail molded with an inlay on its top surface. The overall product is colored to simulate the style of a French fingernail, having lighter colored cuticle and tip end portions and a darker colored central portion.

U.S. Pat. No. 4,751,935 to Mast, et al. discloses an artificial fingernail or tip of polymer plastic containing a light defusing means that provides a textured roughened surface to obtain a natural appearing contrast between the front portion and the cuticle portion of the nail.

U.S. Pat. No. 4,974,610 to Orsini discloses a method of making a set of artificial fingernails wherein a single scene extends across a set of ten artificial fingernails. The image is photographically imprinted on a semi-rigid layer of film and a layer of transparent plastic film is laminated over the layer of photographic film.

In U.S. Pat. No. 4,920,991 to Shebahachi, et al. a thermochromic artificial nail is disclosed which includes a thermochromic material changeable in visible external color in response to a change in temperature.

Each of the references set forth above discloses different structures and combinations to provide ornamental fingernail accessories. Accordingly, it is an object of the present invention to provide an ornamental fingernail accessory having a unique decorative feature. It is a further object of the present invention to provide a kit and a method that allows the wearer to ornament the fingernail accessory as desired.

SUMMARY OF THE INVENTION

The present invention is an ornamental accessory for a fingernail and a method and kit for making the same. The accessory generally includes an overlay, a cover and at least one decorative element. The overlay has a top surface and a bottom surface and a first end and a second end. The first end has a shape and size approximating the shape and size of at least the end of a fingernail or toenail of a wearer for attachment thereto. The top surface has a recess formed therein for receiving at least one decorative element. The cover is fixed to the top surface of the overlay over the recess to form an enclosed pocket for containing one or more decorative elements.

Preferably, the cover is transparent so that the decorative elements can be seen from the top surface of the overlay. The decorative elements may be metallic flakes, glitter, confetti, natural gemstones, artificial gemstones or combinations thereof and are preferably freely movable within the pocket of the overlay.

In an alternate embodiment, the overlay includes a raised decorative portion formed on the top surface as opposed to a recess. Preferably, the raised decorative portion has a textured surface.

A method for adorning a fingernail or toenail in accordance with the present invention includes the steps of attaching an overlay, having a recess formed therein, to the natural fingernail or toenail of a wearer, inserting at least one decorative element within the recess and adhering a cover to the top surface of the overlay over the recess thereby forming an enclosed pocket in the overlay for containing the decorative element.

The present invention may also be provided as a kit for adorning fingernails or toenails. The kit includes an assortment of overlays, decorative elements and covers. The overlays are in various shapes and sizes to be attached to the natural fingernails or toenails of a wearer. Each of the overlays has a recess formed in a top surface thereof for receiving one or more selected decorative elements. The covers are shaped and sized to be adhered to the top surfaces of the overlays over the recesses to form enclosed pockets for containing the decorative elements. Thus, the wearer can create an ornamental fingernail accessory as desired.

For a better understanding of the present invention, reference is made to the following description, taking in conjunction with the accompanying drawings and its scope will be pointed out in the appended claims.

DETAILED DESCRIPTION OF THE PREFERRED EMBODIMENTS

Figure 1:
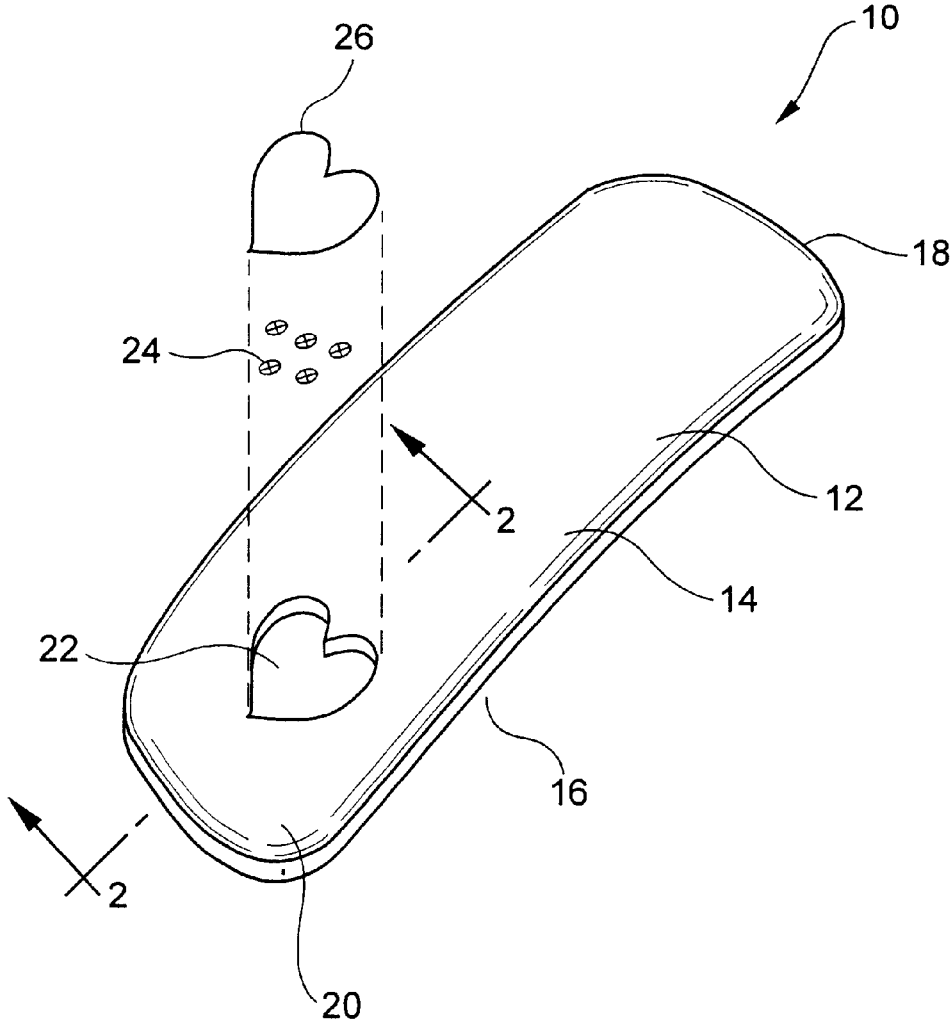
FIG. 1 is an exploded perspective view of the ornamental fingernail accessory formed in accordance with the present invention.
Figure 2A:
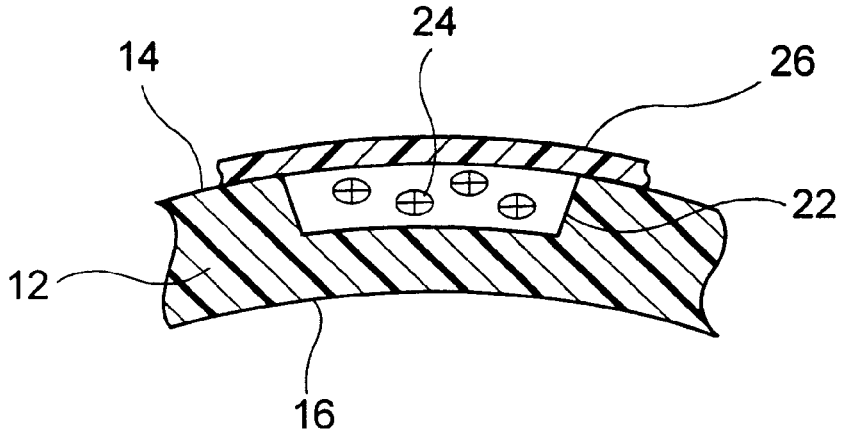
FIG. 2*a* is a cross-sectional view of the ornamental fingernail accessory shown in FIG. 1 taken along the line 2—2.
Figure 2B:
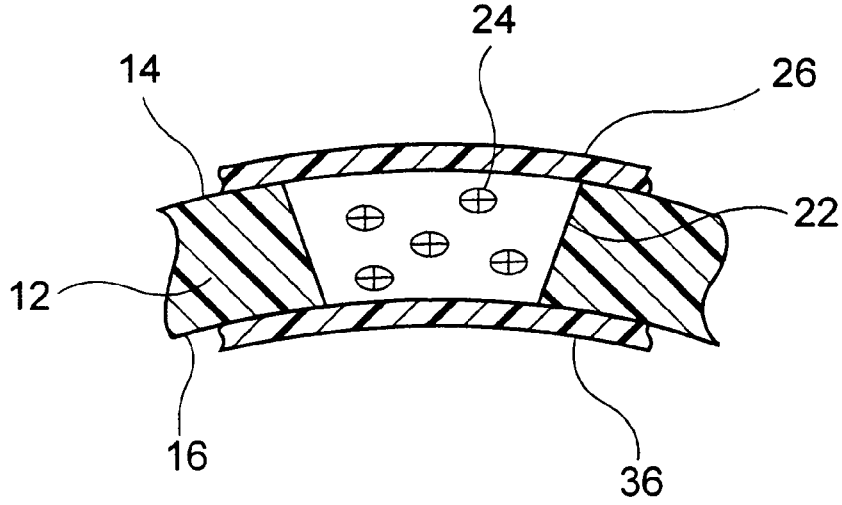
FIG. 2*b* is a cross-sectional view of an alternate embodiment of the ornamental fingernail accessory shown in FIG. 1 taken along the line 2—2.

Referring to FIGS. 1 and 2, an ornamental accessory 10 formed in accordance with the present invention is shown. The ornamental accessory 10 generally includes an overlay 12 having a recess 22 formed therein, a cover 26 fixed over the recess to form an enclosed pocket and one or more decorative inserts 24 contained in the pocket.

The overlay 12 is made using conventional injection molding techniques and may be made from any known artificial fingernail material. Preferably, the overlay 12 is made from a mixture of acrylonitrile-butadiene-styrene (ABS) plastic and polycarbonate. The overlay 12 includes a top surface 14, a bottom surface 16, a first end 18 and a second end 20 that is distal to the first end 18. The first end 18 has a shape and size approximating the shape and size of at least the end of a fingernail or toenail of a wearer for attachment thereto. For example, in the case of a fingernail tip, the first end 18 is in the shape and size approximating the shape and size of only the end of a fingernail of a wearer. In the case of a full fingernail cover, the first end 18 is in approximately the shape and size of a full natural fingernail.

The overlay 12 includes a recess 22 formed in the top surface 14 of the overlay. The recess 22 may be formed during forming of the overlay 12 or may be subsequently provided using conventional machining or cutting techniques. In the preferred embodiment, the recess 22 is proximal to the second end 20 of the overlay 12. The recess 22 may extend from the top surface 14 to a desired depth in the overlay 12 as shown in FIG. 2*a* or it may extend all the way through the overlay 12 from the top surface 14 to the bottom surface 16.

Placed inside the recess 22 is at least one decorative element 24. The decorative elements 24 may be any esthetically pleasing materials that are sized to fit within the recess 22. Preferable materials include metallic flakes, glitter, confetti, natural gemstones and artificial gemstones.

A cover 26 is fixed to the top surface 14 of the overlay 12 over the recess 22 to form an enclosed pocket to contain the decorative elements 24 therein. If the recess 22 extends to the bottom surface 16 of the overlay, a second cover 36 fixed to the bottom surface of the overlay is required. In either case, the decorative elements 24 are preferably freely movable within the pocket formed by the recess and the cover 26 or covers 26 and 36. Preferably, at least the upper cover 26 is made of a thin transparent material so that the decorative elements 24 may be easily seen through the cover 26 from the top surface 14 of the overlay 12. The covers 26 and 36 are also preferably provided with a pressure sensitive adhesive along their peripheries to facilitate fixing the covers to the overlay. Alternatively, an adhesive may be applied to the covers and/or overlay upon assembly. Thus, the covers 26 and 36 may be permanently secured to the overlay 12 or they may be temporarily attached so that the user may later remove the cover 26 and place different decorative elements 24 within the recess 22.

Figure 3:
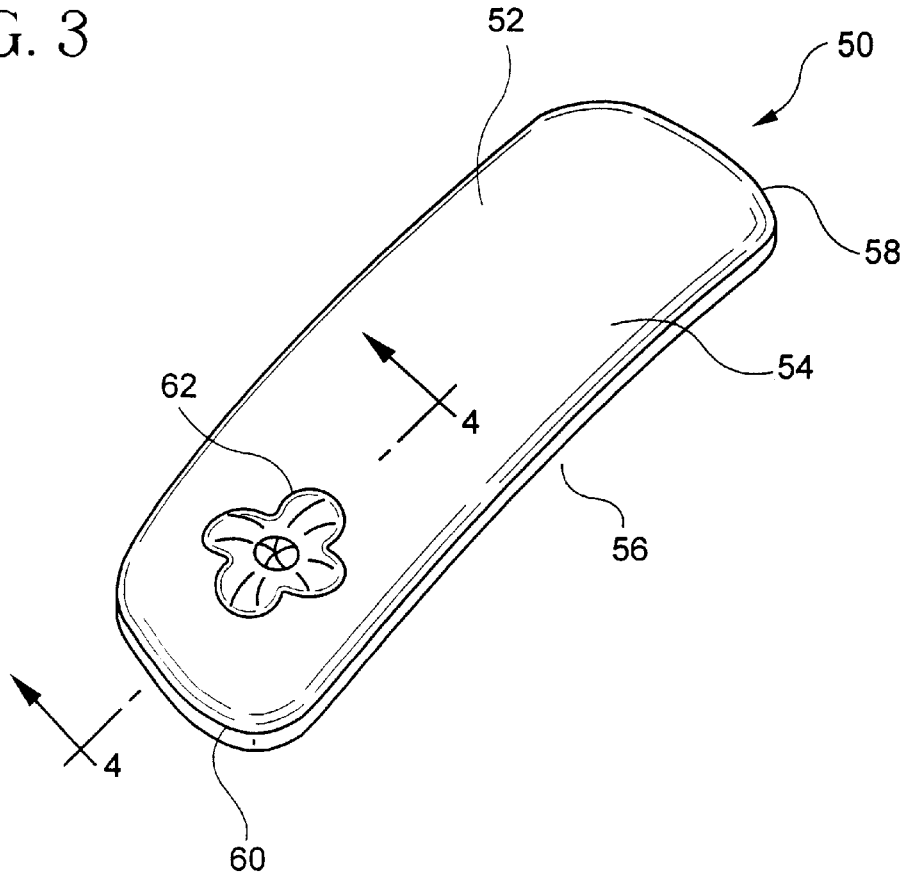
FIG. 3 is a perspective view of another alternate embodiment the ornamental fingernail accessory formed in accordance with the present invention.
Figure 4:
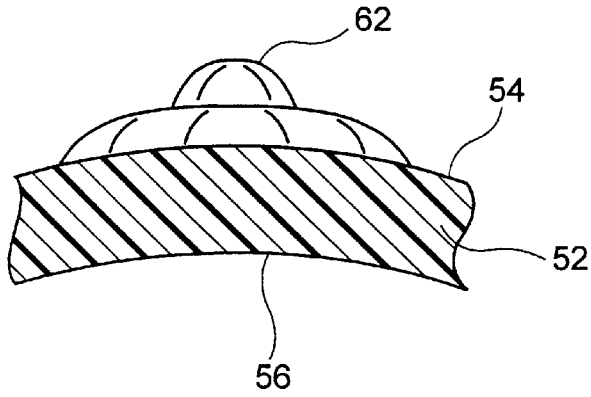
FIG. 4 is a cross-sectional view of the ornamental fingernail accessory shown in FIG. 3 taken along the line 4—4.

An alternate embodiment of the present invention is shown in FIGS. 3 and 4. In the alternate embodiment, the ornamental accessory 50 is made of an overlay 52 with a top surface 54, a bottom surface 56 a first end 58 and a second end 60 as described above. However, as opposed to a recess, the top surface 54 of the overlay 52 is formed with a raised decorative portion 62. The raised decorative portion 62 is formed during molding of the overlay 52 and may be of any ornamental shape or size. Preferably, for added esthetics, the raised decorative portion 62 has a textured surface in contrast to a smooth top surface of the overlay. This is accomplished by providing corresponding textures to the cavity surfaces of the mold used to form the overlay.

Figure 5:
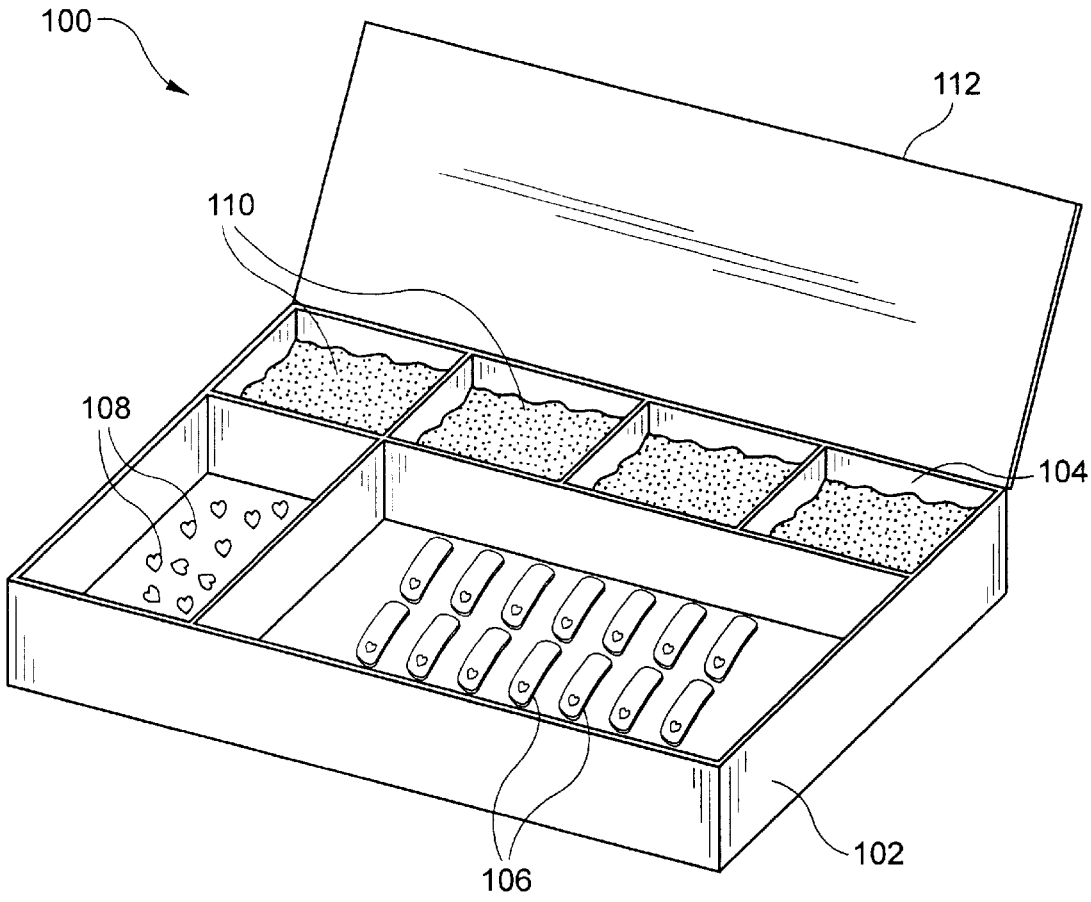
FIG. 5 is a perspective view of a kit for adorning fingernails formed in accordance with the present invention.

The ornamental accessory of the present invention may be offered as part of a kit 100, as shown in FIG. 5, that allows the wearer to design and assemble any desired arrangement of ornamental accessories. The kit 100 generally includes an assortment of overlays 106, covers 108 and decorative elements 110 contained in a storage box 102. The storage box 102 is made with a number of three sided compartments 104 and a lid 112 that may be secured in a closed position to contain all of the kit components.

The kit 100 includes an assortment of differently sized overlays 106 which are sized and shaped to be attached to natural fingernails or toenails of the wearer. Each of the overlays 106 includes a recess formed in its top surface as described above. The kit 100 also includes an assortment of differently sized covers 108 that are used to cover correspondingly sized recesses in the overlays 106. The kit 100 further includes an assortment of decorative elements 110 that may be placed in the recesses of the overlays 106 and then covered by the covers 108 by the wearer. It is envisioned that the kit may include any type of decorative elements, such as metallic flakes, glitter, confetti, natural gemstones and artificial gemstones.

In use, the wearer would first choose an overlay 106 that is close in size to the fingernail or toenail upon which the overlay is to be applied. The wearer then selects one or more desired decorative elements 110, or combinations thereof, and places them within the recess of the overlay. After placing the decorative elements 110 within the recess, a correspondingly sized cover 108 is selected and fixed to the top surface of the overlay 106 over the recess to thereby contain the decorative elements therein. Again, the covers are preferably provided with a pressure sensitive adhesive to facilitate attachment. Alternatively, the kit 100 may include a small container of adhesive that the wearer would apply when assembling the accessory. Once assembled, the overlay 106 is attached to the natural nail using known techniques. As a result, the wearer can create any number of desired ornamental arrangements for the natural nails and can remove and replace the arrangements as desired.

While there has been described what is presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. An ornamental accessory for a fingernail or toenail comprising;

an overlay having a top surface and a bottom surface and a first end and a second end, said first end having a shape and size approximating the shape and size of at least the end of a fingernail or toenail of a wearer for attachment thereto, and said top surface having a recess formed therein;

a cover fixed to said top surface of said overlay over said recess to form an enclosed pocket in said overlay; and at least one decorative element contained in said pocket of said overlay.

2. An ornamental accessory as set forth in claim 1, wherein said cover is transparent.

3. An ornamental accessory as set forth in claim 1, wherein said at least one decorative element is freely movable within said pocket of said overlay.

4. An ornamental accessory as set forth in claim 1, wherein said at least one decorative element is selected from the group comprising metallic flakes, glitter, confetti, natural gemstones and artificial gemstones.

5. An ornamental accessory as set forth in claim 1, wherein said recess extends through said bottom surface of said overlay and said ornamental accessory further comprises a bottom cover fixed to said bottom surface of said overlay over said recess to form an enclosed pocket in said overlay.

6. An ornamental accessory as set forth in claim 1, wherein said overlay is made from a mixture of acrylonitrile-butadiene-styrene (ABS) plastic and a polycarbonate.

7. An ornamental accessory as set forth in claim 1, wherein said first end of said overlay has a shape and size approximating the shape and size of the outer end of the fingernail of a wearer.

8. An ornamental accessory as set forth in claim 1, wherein said first end of said overlay has a shape and size approximating the shape and size of a full fingernail of a wearer.

9. A method for adorning a fingernail or toenail comprising in any order which provides an adornment the steps of:

attaching an overlay to the natural fingernail or toenail of a wearer, said overlay having a recess formed in a top surface thereof;

inserting at least one decorative element within said recess; and adhering a cover to said top surface of said overlay over said recess thereby forming an enclosed pocket in said overlay for containing said at least one decorative element.

10. The method as set forth in claim 9, wherein said cover is transparent.

11. The method as set forth in claim 9, wherein said at least one decorative element is freely movable within said pocket of said overlay.

12. The method as set forth in claim 9, wherein said at least one decorative element is selected from the group comprising metallic flakes, glitter, confetti, natural gemstones and artificial gemstones.

13. A kit for adorning fingernails or toenails comprising:

an assortment of overlays shaped and sized to be attached to the natural fingernails or toenails of a wearer, each of said overlays having a recess formed in a top surface thereof;

a plurality of covers shaped and sized to be adhered to said top surfaces of said overlays over said recesses to form enclosed pockets in said overlays; and an assortment of decorative elements sized to be contained in said enclosed pockets formed in said overlays.

14. A kit as set forth in claim 13, wherein said covers are transparent.

15. A kit as set forth in claim 13, wherein said decorative elements are sized to be freely movable within said pockets of said overlays.

16. A kit as set forth in claim 13, wherein said decorative elements are selected from the group comprising metallic flakes, glitter, confetti, natural gemstones and artificial gemstones.

* * * * *